US007613313B2

(12) United States Patent
Juppi et al.

(10) Patent No.: US 7,613,313 B2
(45) Date of Patent: Nov. 3, 2009

(54) SYSTEM AND METHOD FOR CONTROL OF AUDIO FIELD BASED ON POSITION OF USER

(75) Inventors: Norman Paul Juppi, Palo Alto, CA (US); Subramonlam Narayana Iyer, Fremont, CA (US); April Marie Slayden, Redwood City, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 999 days.

(21) Appl. No.: 10/754,933

(22) Filed: Jan. 9, 2004

(65) Prior Publication Data

US 2005/0152565 A1 Jul. 14, 2005

(51) Int. Cl.
*H04R 5/02* (2006.01)

(52) U.S. Cl. ..... 381/306; 381/77; 381/107; 348/14.08; 348/14.09; 348/169; 348/208.14

(58) Field of Classification Search ..... 381/104–109, 381/77, 80–82, 303, 306, 309, 56, 58–59, 381/304; 700/245; 348/14, 14.07–14.09, 348/169–172, 208.14, 14.1
See application file for complete search history.

(56) References Cited

U.S. PATENT DOCUMENTS 4,764,960 A 8/1988 Aoki et al.
5,146,501 A 9/1992 Spector
5,181,248 A 1/1993 Inanaga et al.
5,386,478 A * 1/1995 Plunkett ..... 381/103
5,495,534 A 2/1996 Inanaga et al.
5,687,239 A 11/1997 Inanaga et al.
6,108,430 A 8/2000 Kurisu
6,118,880 A 9/2000 Kokkosoulis et al.
6,275,258 B1 * 8/2001 Chim ..... 348/211.12
6,292,713 B1 * 9/2001 Jouppi et al. ..... 700/245
6,553,272 B1 * 4/2003 Lau ..... 700/94
6,583,808 B2 * 6/2003 Boulanger et al. ..... 348/14.09

(Continued)

OTHER PUBLICATIONS

Jouppi, "Telepresence system with automatic preservation of user head size", filed on Feb. 27, 2003, U.S. Appl. No. 10/376,435.

(Continued)

*Primary Examiner*—Vivian Chin
*Assistant Examiner*—Disler Paul

(57) ABSTRACT

A system and method for control of an audio field based on the position of the user. In one embodiment, a system and a method for audio reproduction are provided. One or more audio signals are obtained that are representative of sounds occurring at a first location. The audio signals are communicated from the first location to a second location of a person. A position of the head of the person is determined in at least two dimensions at the second location by obtaining at least one image of the person. An audio field is reproduced at the second location from the audio signals, wherein sounds emitted by each means for reproducing are controlled based on the position of the head of the person. This may include controlling the volume of reproduction by each of a plurality of sound reproductions means based on the position of the head of the person. In another embodiment, delay associated with of reproduction may be controlled based on the position of the head of the person.

25 Claims, 3 Drawing Sheets

U.S. PATENT DOCUMENTS

| | | | | |
|---|---|---|---|---|
| 6,639,989 | B1 * | 10/2003 | Zacharov et al. | 381/303 |
| 6,757,397 | B1 * | 6/2004 | Buecher et al. | 381/122 |
| 6,925,357 | B2 * | 8/2005 | Wang et al. | 700/245 |
| 7,092,001 | B2 * | 8/2006 | Schulz | 348/14.05 |
| 7,095,455 | B2 * | 8/2006 | Jordan et al. | 348/734 |
| 7,177,413 | B2 * | 2/2007 | O'Toole | 379/202.01 |
| 2002/0090094 | A1 * | 7/2002 | Amir et al. | 381/92 |
| 2002/0118861 | A1 | 8/2002 | Jouppi et al. | |
| 2002/0141595 | A1 * | 10/2002 | Jouppi | 381/2 |
| 2003/0067536 | A1 * | 4/2003 | Boulanger et al. | 348/14.08 |
| 2003/0093668 | A1 * | 5/2003 | Multerer et al. | 713/161 |
| 2003/0144768 | A1 * | 7/2003 | Hennion et al. | 701/2 |

OTHER PUBLICATIONS

Jens Blauert, "Spatial Hearing—The Psychophysics of Human Sound Localization", Revised Edition, The MIT Press, Cambridge, Mass. 2001.

* cited by examiner

SYSTEM AND METHOD FOR CONTROL OF AUDIO FIELD BASED ON POSITION OF USER

FIELD OF THE INVENTION

The present invention relates to the field of audio reproduction. More particularly, the present invention relates to the field of audio reproduction for telepresence systems in which a display booth provides an immersion scene from a remote location.

BACKGROUND OF THE INVENTION

Telepresence systems allow a user at one location to view a remote location (e.g., a conference room) as if they were present at the remote location. Mutually-immersive telepresence system environments allow the user to interact with individuals present at the remote location. In a mutually-immersive environment, the user occupies a display booth, which includes a projection surface that typically surrounds the user. Cameras are positioned about the display booth to collect images of the user. Live color images of the user are acquired by the cameras and subsequently transmitted to the remote location, concurrent with projection of live video on the projection surface surrounding the user and reproduction of sounds from the remote location.

Ideally, the mutually immersive telepresence system would provide an audio-visual experience for both the user and remote participants that is as close to that of the user being present in the remote location as possible. For example, sounds reproduced at the display booth should be aligned with sources of the sounds being displayed by the booth. However, when the user moves within the display booth so that the user is closer to one speaker than another, sounds may instead appear to come from the speaker to which the user is closest. This effect is particularly acute when the user is relatively close to the speakers, as in a telepresence display booth.

What is needed is a system and method for control of audio, particularly for a telepresence system, which overcomes the aforementioned drawback.

SUMMARY OF THE INVENTION

The present invention provides a system and method for control of an audio field based on the position of the user. In one embodiment, a system and a method for audio reproduction are provided. One or more audio signals are obtained that are representative of sounds occurring at a first location. The audio signals are communicated from the first location to a second location of a person. A position of the head of the person is determined in at least two dimensions at the second location by obtaining at least one image of the person. An audio field is reproduced at the second location from the audio signals, wherein sounds emitted by each means for reproducing are controlled based on the position of the head of the person. This may include controlling the volume of reproduction by each of a plurality of sound reproductions means based on the position of the head of the person. In another embodiment, delay associated with of reproduction may be controlled based on the position of the head of the person. These and other aspects of the present invention are described in more detail herein.

BRIEF DESCRIPTION OF THE DRAWINGS

The present invention is described with respect to particular exemplary embodiments thereof and reference is accordingly made to the drawings in which.

DETAILED DESCRIPTION OF A PREFERRED EMBODIMENT

The present invention provides a system and method for control of an audio field based on the position of a user. The invention is particularly useful for a telepresence system. In a preferred embodiment, the invention tracks the position of the user in two or three dimensions in front of a display screen. For example, the user may be within a display apparatus having display screens that surround the user. Visual images are displayed for the user including visual objects that are the sources of sounds, such as images of persons who are conversing with the user. Based on the user's position, particularly the position of the user's head, the system modifies a corresponding directional audio stream being reproduced for the user in order to align the perceived source of the directional audio to its corresponding visual object on the display screen. By tracking the user's head position and modifying the audio signals appropriately in one or both of volume and arrive time, the perceived auditory source is more closely aligned with their corresponding visual source so that audio and visual cues tend to be aligned rather than conflicting. As a result, the experience of the user of the system is more immersive.

Figure 1:
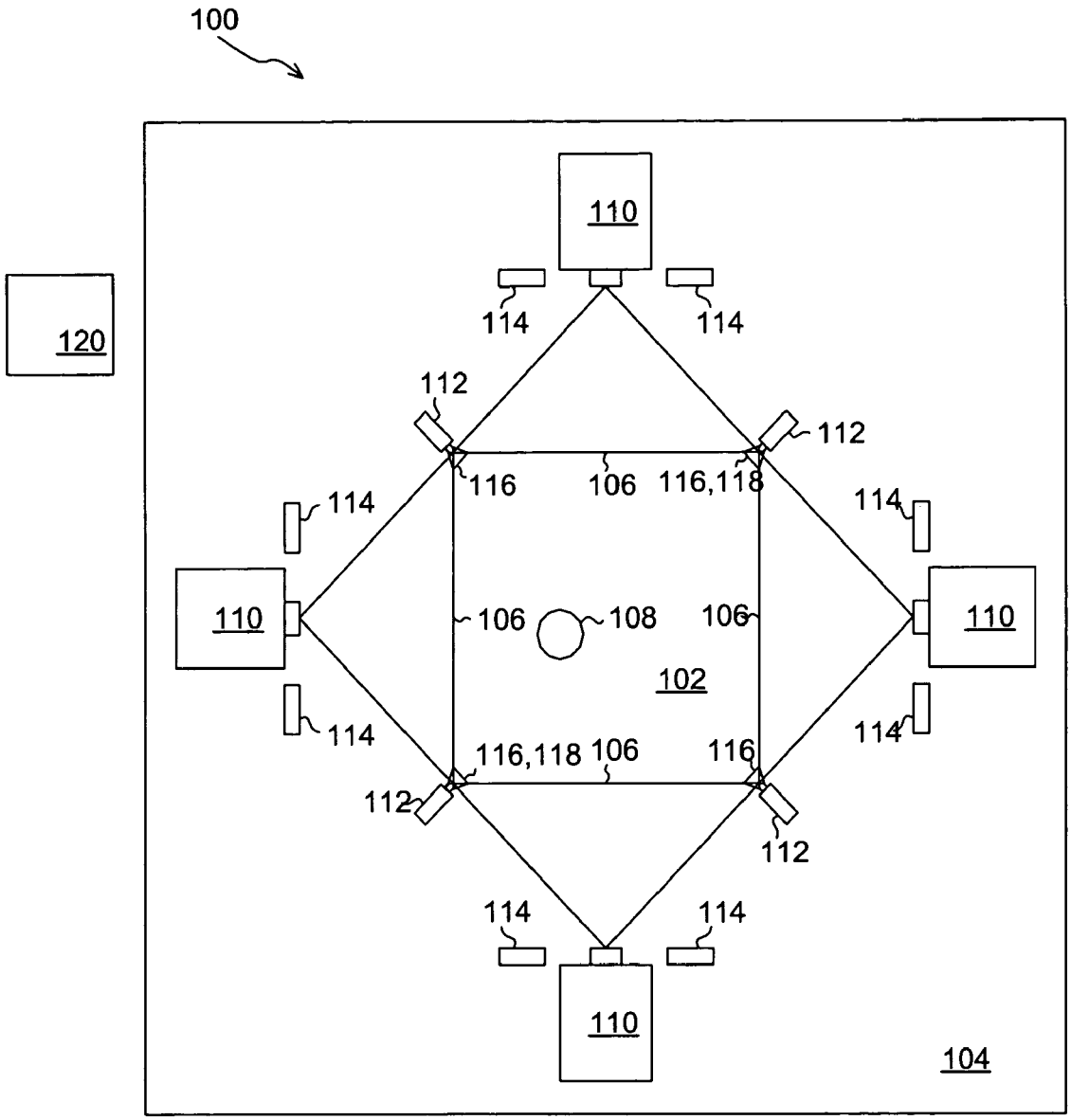
FIG. 1 illustrates a display apparatus according to an embodiment of the present invention.

A plan view of an embodiment of the display apparatus is illustrated schematically in FIG. 1. The display apparatus 100 comprises a display booth 102 and a projection room 104 surrounding the display booth 102. The display booth comprises display screens 106 which may be rear projection screens. A user's head 108 is depicted-within the display booth 102. The projection room 104 comprises projectors 110, camera units 112, near infrared illuminators 114, and speakers 116. These elements are preferably positioned so as to avoid interfering with the display screens 106. Thus, according to an embodiment, the camera units 112 and the speakers 116 protrude into the display booth 102 at corners between adjacent ones of the display screens 106. Preferably, a pair of speakers 116 is provided at each corner, with one speaker being positioned above the other. Alternately, each pair of speakers 116 may be positioned at the middle of the screens 106 with one speaker of the pair being above the screen and the other being below the screen. In a preferred embodiment, two subwoofers 118 are provided, though one or both of the subwoofers may be omitted. One subwoofer is preferably placed at the intersection of two screens and outputs low frequency signals for the four speakers associated with those screens. The other subwoofer is placed opposite from the first, and outputs low frequency signals associated with the other two screens.

A computer 120 is coupled to the projectors 110, the camera units 112, and the speakers 116. Preferably, the computer 120 is located outside the projection room 104 in order to eliminate it as a source of unwanted sound. The computer 120 provides video signals to the projectors 110 and audio signals to the speakers 116 from the remote location. The computer also collects images of the user 108 via the camera units 112 and sound from the user 108 via one or more microphones (not shown), which are transmitted to the remote location. Audio signals may be collected using a lapel microphone attached to the user 108.

In operation, the projectors 110 project images onto the projection screens 106. The surrogate at the remote location provides the images. This provides the user 108 with a surrounding view of the remote location. The near infrared illuminators 114 uniformly illuminate the rear projection screens 106. Each of the camera units 112 comprises a color camera and a near infrared camera. The near infrared cameras of the camera units 112 detect the rear projection screens 106 with a dark region corresponding to the user's head 108. This provides a feedback mechanism for collecting images of the user's head 108 via the color cameras of the camera units 112 and provides a mechanism for tracking the location of the user's head 108 within the apparatus.

Figure 2:
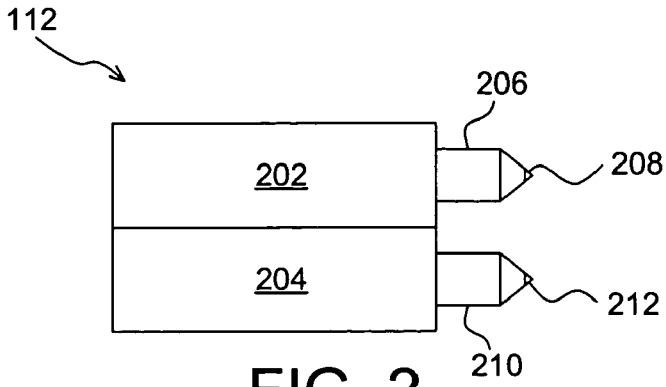
FIG. 2 illustrates a camera unit according to an embodiment of the present invention.

An embodiment of one of the camera units 112 is illustrated in FIG. 2. The camera unit 112 comprises the color camera 202 and the near infrared camera 204. The color camera 202 comprises a first extension 206, which includes a first pin-hole lens 208. The near infrared camera 204 comprises a second extension 210, which includes a second pin-hole lens 212. The near-infrared camera 204 obtains a still image of the display apparatus with the user absent (i.e. a baseline image). Then, when the user is present in the display apparatus, the baseline image is subtracted from images newly obtained by the near-infrared camera 204. The resulting difference images show only the user and can be used to determine the position of the user, as explained herein. This is referred to as difference keying. The difference images are also preferably filtered for noise and other artifacts (e.g., by ignoring difference values that fall below a predetermined threshold).

Figure 3:
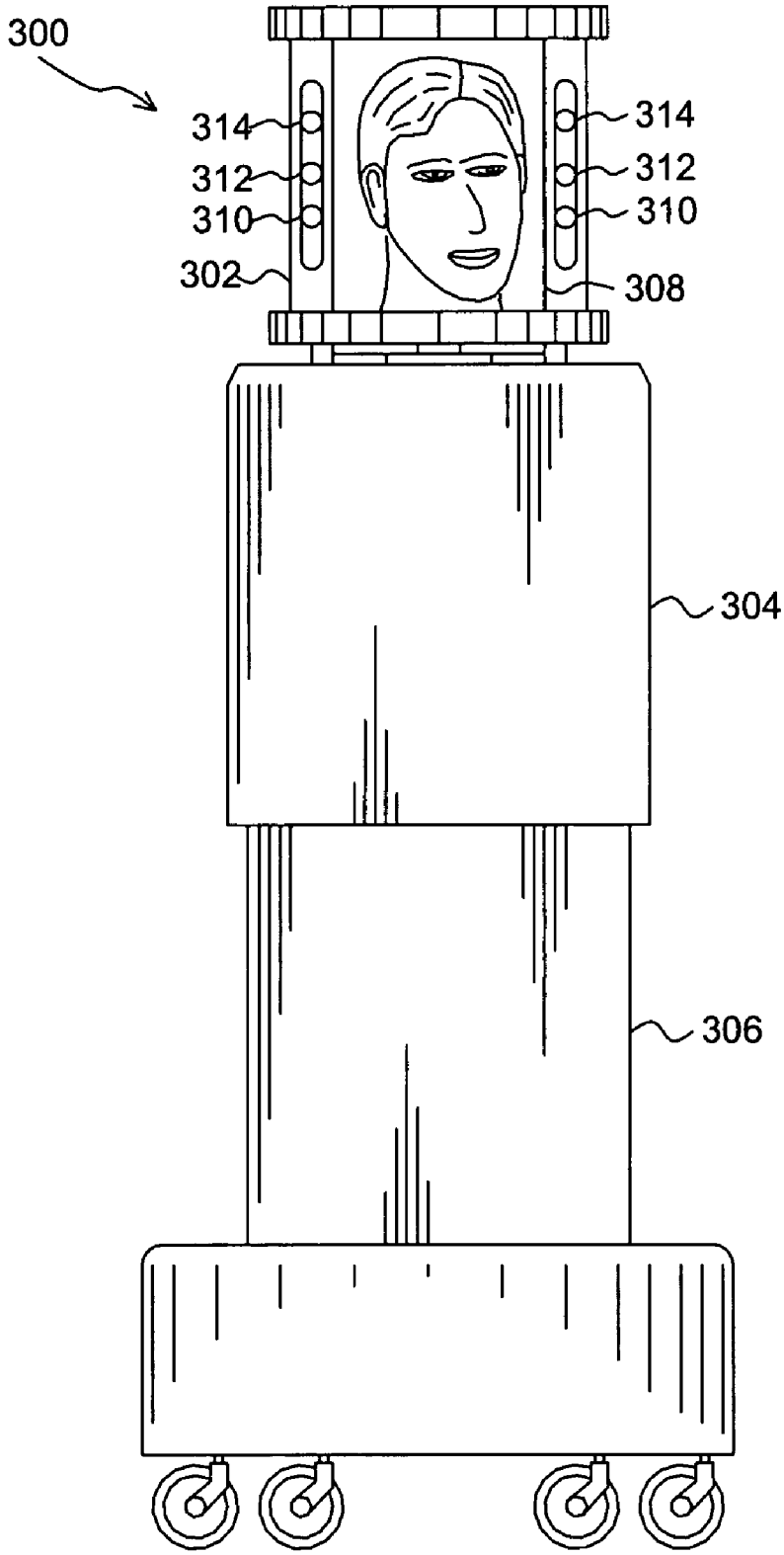
FIG. 3 illustrates a surrogate according to an embodiment of the present invention.

An embodiment of the surrogate is illustrated in FIG. 3. The surrogate 300 comprises a surrogate head 302, an upper body 304, a lower body 306, and a computer (not shown). The surrogate head comprises a surrogate face display 308, a speaker 310, a camera 312, and a microphone 314. Preferably, the surrogate face display comprises an LCD panel. Alternatively, the surrogate face display comprises another display such as a CRT display. Preferably, the surrogate 300 comprises four of the surrogate face displays 308, four of the speakers 310, four of the cameras 312, and four of the microphones 314 with a set of each facing a direction orthogonal to the others. Alternatively, the surrogate 300 comprises more or less of the surrogate face displays 308, more or less of the speakers 310, more or less of the cameras 312, or more or less of the microphones 314.

In operation, the surrogate 300 provides the video and audio of the user to the remote location via the face displays 308 and the speakers 310. The surrogate 300 also provides video and audio from the remote location to the user 108 in the display booth 102 (FIG. 1) via the cameras 312 and the microphones 314. A high speed network link couples the display apparatus 100 and the surrogate 300 and transmits the audio and video between the two locations. The upper body 304 moves up and down with respect to the lower body 306 in order to simulate a height of the user at the remote location.

According to an embodiment of the display apparatus 100 (FIG. 1), walls and a ceiling of the projection room 104 are covered with anechoic foam to improve acoustics within the display booth 102. Also, to improve the acoustics within the display booth 102, a floor of the projection room 104 is covered with carpeting. Further, the projectors 110 are placed within hush boxes to further improve the acoustics within the display booth 102. Surfaces within the projection room 104 are black in order to minimize stray light from the projection room 104 entering the display booth 102. This also improves a contrast for the display screens 106.

To determine the position of the user's head 108 in two dimensions or three dimensions relative to the first and second camera sets, several techniques may be used. For example, conventionally known near-infrared (NIR) difference keying or chroma-key techniques may be used with the camera sets 112, which may include combinations of near-infrared or video cameras. The position of the user's head is preferably monitored continuously so that new values for its position are provided repeatedly.

Figure 4:
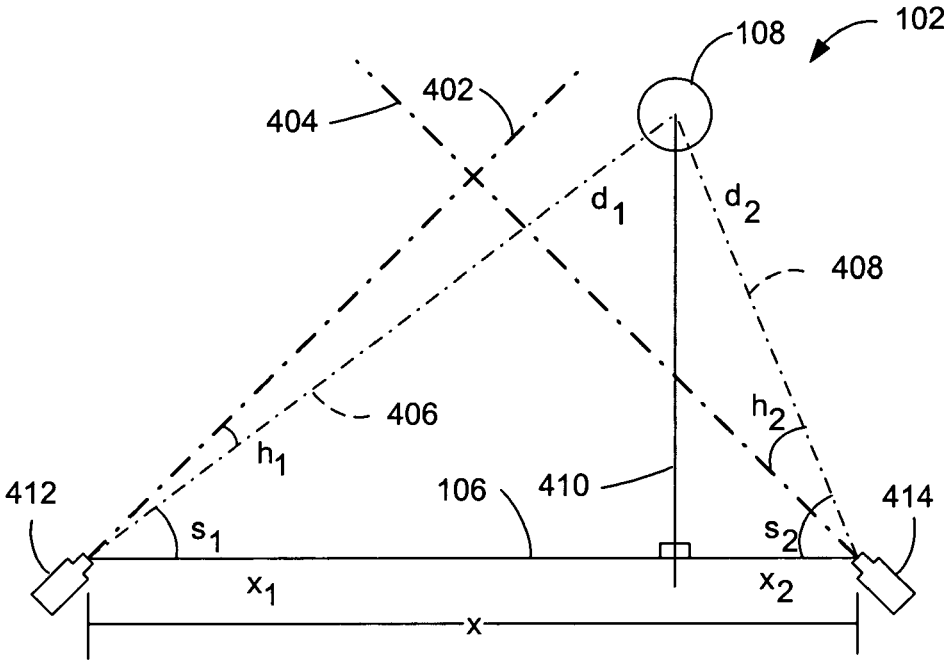
FIG. 4 illustrates a view from above at a user's location according to an embodiment of the present invention.

Referring now to FIG. 4, therein is shown the user's location (e.g., in projection room 104) looking down above. In this embodiment, first and second camera sets 412 and 414 are used as an example. The distance x between the first and second camera sets 412 and 414 is known, as are angles h1 and h2 between centerlines 402 and 404 of sight of the first and second camera sets 412 and 414, and centerlines 406 and 408 respectively to the user's head 108.

Figure 5:
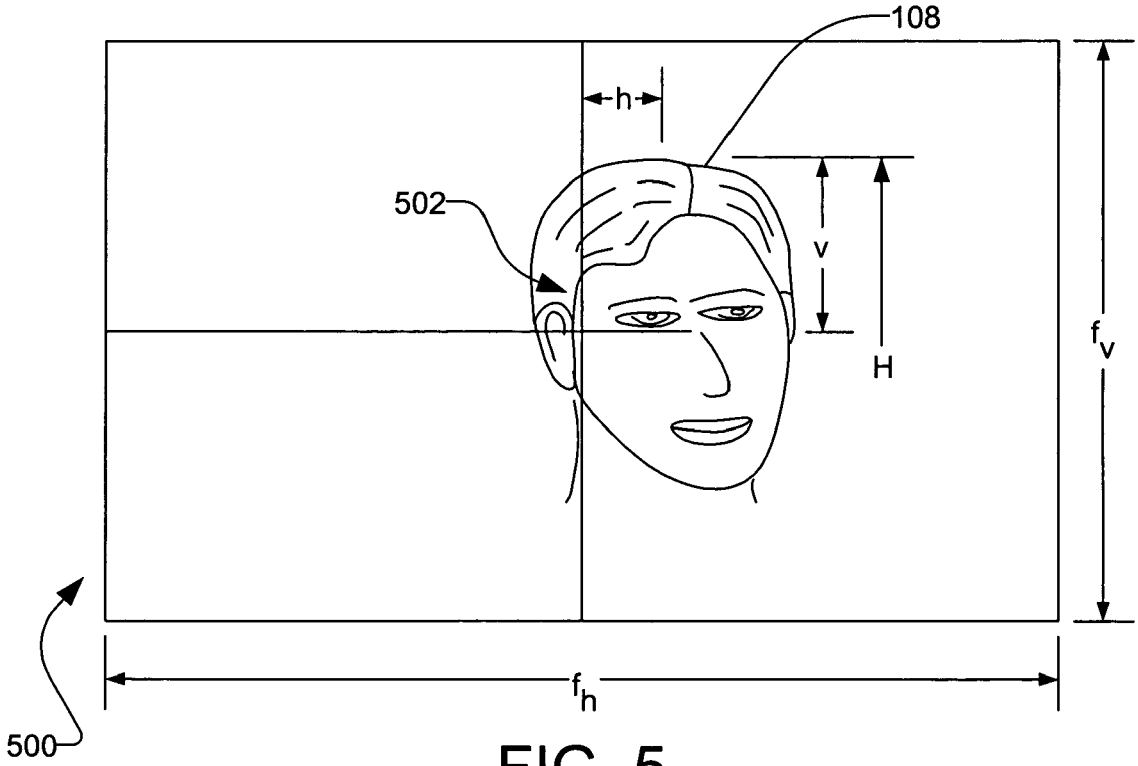
FIG. 5 illustrates a view from one of the cameras of the display apparatus according to an embodiment of the present invention.

The centerlines 406 and 408 can be determined by detecting the location of the user's head within images obtained from each camera set 412 and 414. Referring to FIG. 5, therein is shown a user's image 500 from either the first and second camera sets 412 or 414 mounted beside the user's display 106 used in determining the user's head location. For example, where luminance keying is used, the near-infrared light provides the background that is used by a near-infrared camera in detecting the luminance difference between the head of the user and the rear projection screen. Any luminance detected by the near-infrared camera outside of a range of values specified as background is considered to be in the foreground. Once the foreground has been distinguished from the background, the user's head may then be located in the image. The foreground image may be scanned from top to bottom in order to determine the location of the user's head. Preferably, the foreground image is scanned in a series of parallel lines (i.e. scan lines) until a predetermined number, h, of adjacent pixels within a scan line, having a luminance value within foreground tolerance are detected. In an exemplary embodiment, h equals 10. This detected region is assumed to be the top of the local user's head. By requiring a number of adjacent pixels to have similar luminance values, the detection of false signals due to video noise or capture glitches are avoided. Then, a portion of the user's head preferably below the forehead and approximately at eye-level is located. This measurement may be performed by moving a distance equal to a percentage of the total number of scan lines (e.g., 10%) down from the top of the originally detected (captured) foreground image. The percentage actually used may a user-definable parameter that controls how far down the image to move when locating this approximately eye-level portion of the user's head.

A middle position between the left-most and right-most edges of the foreground image at this location indicates the locations of the centerlines 406 and 408 of the user's head. Angles hi and $h_2$ between centerlines 402 and 404 of sight of the first and second camera sets 712 and 714 and the centerlines 406 and 408 to the user's head shown in FIG. 4 can be determined by a processor comparing the horizontal angular position h to the horizontal field of view of the camera $f_h$ shown in FIG. 5. The combination of camera and lens determines the overall vertical and horizontal fields of view of the user's image 500.

It is also known that the first and second camera sets 412 and 414 have the centerlines 402 and 404 set relative to each other; preferably 90 degrees. If the first and second camera sets 412 and 414 are angled at 45 degrees relative to the user's display screen, the angles between the user's display screen and the centerlines 406 and 408 to the user's head are $s_1=45-h_1$ and $s_2=45+h_2$. From trigonometry:

$$x_1*\tan s_1=y=x_2*\tan s_2 \quad \text{Equation 1}$$

and $$x_1+x_2=x \quad \text{Equation 2}$$

so $$x_1*\tan s_1=(x-x_1)*\tan s_2 \quad \text{Equation 3}$$

regrouping $$x_1*(\tan s_1+\tan s_2)=x*\tan s_2 \quad \text{Equation 4}$$

solving for $x_1$ $$x_1=(x*\tan s_2)/(\tan s_1+\tan s_2) \quad \text{Equation 5}$$

The above may also be solved for $x_2$ in a similar manner. Then, knowing either $x_1$ or $x_2$, y is computed. To reduce errors, y 410 may be computed from both $x_1$ and $x_2$ and an average value of these values for y may be used.

Then, the distances from each camera to the user can be computed as follows:

$$d_1=y/\sin s_1 \quad \text{Equation 6}$$

$$d_2=y/\sin s_2 \quad \text{Equation 7}$$

In this way, the position of the user can be determined in two dimensions (horizontal or X and Y coordinates) using an image from each of two cameras. To reduce errors, the position of the user can also be determined using other sets of cameras and the results averaged.

Referring again to FIG. 5, therein is shown a user's image 500 from either the first and second camera sets 412 or 414 mounted beside the user's display 106 which may be used in determining the user's head height. Based on this vertical field of view of the camera set and the position of the user's head 108 in the field of view, a vertical angle v between the top center of the user's head 108 and an optical center 502 of the user's image 500 can be computed by a processor. From this, the height H of the user's head 108 above a floor can be computed. U.S. patent application Ser. No. 10/376,435, filed Feb. 2, 2003, the entire contents of which are hereby incorporated by reference, describes a telepresence system with automatic preservation of user head size, including a technique for determining the position of a user's head in three dimensions or in X, Y and Z coordinates. The techniques described above determine the position of the top of the user's head. It may be desired to locate the user's ears more precisely for controlling the audio field. Thus, the position of the user's ears can be estimated by subtracting a predetermined vertical distance, such as 5.5 inches, from the position of the top of the user's head.

In an embodiment, display screens are positioned on all four sides of the user, with speakers at the corners of the booth 102. Thus, four speakers may be provided, one at each corner. In a preferred embodiment, however, eight speakers are provided in pairs of an upper and lower speaker at the corners of the booth, so that a speaker is positioned near a corner of each screen. Alternately, a speaker may be positioned above and below approximately the center of each screen. Thus, at least eight speakers are preferably provided in four pairs. In addition, four audio channels are preferably obtained using the four microphones at the surrogate's location and reproduced for the user: left, front, right, and back. Each channel is reproduced by a pair of the speakers.

It will be apparent that this configuration is exemplary and that more or fewer display screens and/or audio channels may be provided. For example, sides without projection screens may have either one speaker at the center of where the screen would be, or speakers above and below the center of where the screen would be or speakers where the corners would be, as on the sides with projection screens.

The computer 120 (FIG. 1) at the user's location receives the four channels of audio data from the surrogate 300 and outputs eight channels to the eight speakers around the user. Each speaker is driven from a digital-to-analog converter in the computer through an amplifier (not shown) to the speaker channel. Since the directionality of low-frequency sounds are not auralized as well by people as high frequency sounds, several speaker channels may share a subwoofer via a crossover network.

In one embodiment, the audio is modified in an effort to achieve horizontal balance of loudness. For this embodiment, four or eight speakers may be used. Where eight speakers are used, the same signal loudness may be applied to the upper and lower speaker of each pair.

To accomplish this, it is desired for the perceived volume level of each speaker to be roughly the same independent of the position of the user's head. To maintain equal loudness, the audio signal for the further speaker is increased and the signal going to the closer speaker is reduced. To achieve volume balance, the signal level that would be heard from each speaker by the user if their head was centered in front of the screen may be determined, and then the level of each signal is modified to achieve this same total volume when the user's head is not centered.

For speakers operating in the linear region, signal power is proportional to the square of the voltage. So a quadrupling of the signal power can be achieved by doubling the voltage going to a speaker, and a quartering of the signal power can be achieved by halving the voltage going to a speaker. For example, if the user has moved so that he or she is twice as far from the further speaker, but half as far from the closer speaker, the signal power going to the further speaker should be quadrupled while the signal power going to the closer speaker should be quartered. Doubling or halving the voltage going to the speaker can be accomplished by doubling or halving data values going to a corresponding digital-to-analog converter of the computer.

Thus, for each of the four audio channels n=1 through 4, the voltage signal $V_n$ used to drive the corresponding speaker may be computed as follows:

$$V_n=d_n/d_c*V_s \quad \text{Equation 8}$$

where $d_c$ is the horizontal distance from the speaker to the center of the booth 102, $d_n$ is the horizontal distance from the speaker to the user's head 108 and $V_s$ is the current voltage sample (or input voltage level) for audio channel n. As mentioned, where eight speakers are used, the speakers of each pair may receive the same signal level. Preferably, this computation is repeatedly performed for each speaker channel as new values for d, are repeatedly determined based on the user changing positions.

Any changes to the volume are preferably made gradually over many samples, so that audible discontinuities are not produced. For example, the voltage could be increased or decreased by at most one percent every ten milliseconds, or roughly a maximum rate of 100 percent every second.

In a preferred embodiment, the audio sample rate is 40 KHz (or 40,000 samples per second). In addition, a change from a current volume level to the desired volume is preferably made in equal intervals of 1/10 of the sample rate. Thus, the volume is changed by one increment for every 10 samples (or one increment every 25 milliseconds). The increment is preferably computed so as to effect the change in one second. Thus, the increment is the difference in desired voltage and current voltage divided by 1/10 the sample rate. In other words, for a 40 KHz sample rate, each increment is 1/4000 of the difference between the desired voltage and the current voltage. For example, if the current voltage is 10 and the desired voltage is 6, then the difference is 4 and the increment is 4/4000 or 0.001 volts. Thus, it takes 4000 incremental changes of ×0.001 volts to reach the desired voltage. If the sampling rate is 40,000 Hz and it takes 4000 increments that are performed ten samples apart, then it takes exactly one second to effect the change.

In an embodiment, the audio is modified to in an effort to achieve time delay balance. To achieve time delay balance, the delay experienced by the user if their head was centered in front of the screen is determined for each speaker. Typically, the delay for each channel will be equal when the user is centered in the display booth. Then when the user's head is not centered the delay of each signal is modified to achieve this same delay. For example, if the user has moved so that he or she is one foot further from the further speaker, but one foot closer to the closer speaker, the signal going to the further speaker should be time advanced relative to the signal going to the closer speaker. To maintain equal arrival times, for each foot that the further speaker is further away from the original centered position of the user's head, we need to advance the signal going to the further speaker by approximately one millisecond. This is because sound travels at a speed of approximately 1000 feet per second (though more precisely at 1137 ft./sec), or equivalently about one foot per millisecond. Similarly, if the closer speaker is a foot closer to the user's head than in the original centered position, the signal going to the closer speaker should be delayed by approximately one millisecond.

This skewing can be accomplished by changing the position of data going to be output to each speaker in the digital-to-analog converter of the computer. For example at a sampling rate of 40 KHz, changing the timing of an output channel by a millisecond means skewing the data back or forth by 40 samples. Or, if four times over-sampling is used, the output should be skewed by 160 samples per millisecond.

Thus, for each of the four audio channels n=1 through 4, delay for driving the corresponding speaker may be computed as follows:

$$T_d = T_b - (d_n/S) \qquad \text{Equation 9}$$

where $T_d$ is the desired delay for the channel, $T_b$ is the time required for sound to travel across the booth, $d_n$ is the horizontal distance from the speaker to the user's head 108 and S is the speed of sound in air. Preferably, this computation is repeatedly performed for each speaker channel as new values for $d_n$ are determined based on the user changing positions. For example, for a cube having a 6-foot diagonal, $T_b$ is approximately 5.3 ms. Thus, where the person's head is right next to the speaker ($d_n$=0), and the desired delay $T_d$ is approximately 5.3 ms; when the persons head is at the opposite side of the cube ($d_n$=6 ft), and the delay is approximately zero.

Note that as the user moves their head, and the desired skews of the channels change, abrupt changes to the sample skewing could create audible artifacts in the audio output. Thus, the skew of a channel is preferably changed gradually and possibly in the quieter portions of the output stream. For example, one sample could be added or subtracted from the skew every millisecond when the audio waveform was below one quarter of its peak volume.

In a preferred embodiment, if the desired delay is greater than the actual delay, the actual delay is gradually increased; if the desired delay is less than the actual delay the actual delay is gradually decreased. Where the desired delay is approximately equal (e.g., within approximately 4 samples) to the current delay, no change is required. The rate of change of delay is preferably +/−10% of the sampling rate (i.e. 4 samples per ms). Thus, for example, if the actual delay for an audio channel is 100 samples and the desired delay is 80 samples, the delay is reduced by 20 samples which, when done gradually, takes 5 ms.

In an embodiment, the audio is modified in an effort to achieve vertical loudness balance, in addition to the horizontal loudness balance described above. In this case, four pairs of upper and lower speakers are preferably provided. The relative outputs for the upper and lower speaker for each pair are modified so that the user experiences approximately the same loudness from the pair when the user changes vertical positions.

In one embodiment for achieving vertical loudness balance, the distance from the user's head to the upper and lower speakers, including horizontal and vertical components, is calculated using the position of the user's head in the X, Y and Z dimensions.

Thus, for each of the four audio channels n=1 through 4, the voltage signal $V_{n(upper)}$ used to drive the corresponding upper speaker and the voltage signal $V_{n(lower)}$ used to drive the corresponding lower speaker may be computed as follows:

$$V_{n(upper)} = d_{n(upper)}/d_{c(upper)} * V_{s(upper)} \qquad \text{Equation 10}$$

$$V_{n(lower)} = d_{n(lower)}/d_{c(lower)} * V_{s(lower)} \qquad \text{Equation 11}$$

where $d_{c(upper)}$ is the distance from the upper speaker of the pair to the center of the booth 102, $d_{c(lower)}$ is the distance from the upper speaker of the pair to the center of the booth 102, $d_{n(upper)}$ is the distance from the upper speaker to the user's head 108, $d_{n(lower)}$ is the distance from the lower speaker to the user's head 108, $V_{s(upper)}$ is the current voltage sample for the upper speaker for audio channel n and $V_{s(lower)}$ is the current voltage sample for the lower speaker. As before, changes in loudness are preferably performed gradually.

In another embodiment for achieving vertical loudness balance, the vertical position H of the user's head is compared to a threshold $H_{th}$. When the vertical position H is above the threshold, substantially all of the sound for a channel is directed to the upper speaker of each pair and, when the vertical position is below the threshold, substantially all of the sound for the channel is directed to the lower speaker of the pair. Thus, at any one time, only one of the speakers for a pair is active. To avoid unwanted sound discontinuities when transitioning from the upper to lower or lower to upper speaker for a pair, the volume of one is gradually decreased while the volume of the other is gradually increased. This gradual transition or fade preferably occurs over a time period of 100 ms.

To avoid transitioning frequently when the user is positioned near the threshold level $H_{th}$, hysteresis is preferably employed. Thus, when the user's vertical position H is below the threshold $H_{th}$, the user's vertical position must rise above a second threshold $H_{th2}$ before the audio signal is transitioned to the upper speaker. Similarly, when the user's vertical position H is above the second threshold $H_{th2}$, the user's vertical position must fall below the first threshold $H_{th}$ before the audio signal is transitioned back to the lower speaker.

By adjusting the loudness balance, feedback from the user to the remote location and back can be reduced. For example, if the user and their lapel microphone are close to one speaker, the gain when transmitting from that speaker to the user's lapel microphone would be higher than when the user and their lapel microphone are centered in the display cube. This would result in an increase in the gain of feedback signals. By adjusting the perceived volume to be the same as if the user was centered, this effect is minimized.

In another embodiment, delay in the audio signal delivered to each speaker is also adjusted in response to the vertical position of the user's head. Thus, the relative outputs for the upper and lower speaker for each pair are modified so that they arrive at the user's head at the same time and with the same loudness. To do this, the distance from the user's head to the upper speaker and the lower speaker, including horizontal and vertical components, are calculated. One speaker will generally be closer to the user's head than the other and, thus, the delay for the speaker that is closer is advanced relative to the speaker that is further, where the amount of change in the delay for each speaker is determined from its distance to the user's head.

Thus, for each of the four audio channels n=1 through 4, delay for driving the corresponding speaker may be computed as follows:

$$T_{d(upper)}=T_b-(d_{n(upper)}/S) \quad \text{Equation 12}$$

$$T_{d(lower)}=T_b-(d_{n(lower)}/S) \quad \text{Equation 13}$$

where $T_{d(upper)}$ is the desired delay for the upper speaker of a pair, $T_{d(lower)}$ is the desired delay for the lower speaker of the pair, $T_b$ is the time required for sound to travel across the booth, $d_{n(upper)}$ is the distance from the upper speaker to the user's head 108, $d_{n(lower)}$ is the distance from the lower speaker to the user's head 108, and S is the speed of sound in air.

Thus, in a preferred embodiment, the timing and volume is adjusted for each of the four directional channels (left, front, right, and back) and for upper and lower speakers for each of the four channels based on the horizontal and vertical position of the user so that sounds from the different directional channels have the same perceived volume and arrival time as if the user was actually centered in front of the display(s). In other embodiments, fewer adjustment parameters may be used (e.g., based on the user's horizontal position only, only the volume may be adjusted, etc.).

The foregoing detailed description of the present invention is provided for the purposes of illustration and is not intended to be exhaustive or to limit the invention to the embodiments disclosed. Accordingly, the scope of the present invention is defined by the appended claims.

What is claimed is:

1. A system for audio reproduction comprising:

means for obtaining one or more audio signals that are representative of sounds occurring at a first location;

means for communicating the audio signals from the first location to a second location of a person;

means for determining a position of the head of the person in at least two dimensions at the second location by imaging the person; and plural means for reproducing an audio field at the second location from the audio signals, wherein sounds emitted by each means for reproducing are controlled based on the position of the head of the person, wherein the plural means for reproducing are arranged spaced apart and directed toward a center and wherein a particular one of the audio signals applied to a particular one of the means for reproducing is time delayed based on the position of the person to maintain equal arrival times of the sounds to the person as the person moves around to different locations at the second location, wherein a perceived volume of the sound by the person is equal and independent of the position of the head of the person as the person moves around the second location.

2. The system according to claim 1, wherein the audio signals applied to the plural means for reproducing are multiplied by a ratio of a horizontal distance between the plural means for reproducing and the head of the person to a horizontal distance between the plural means for reproducing and the center.

3. The system according to claim 1, wherein said means for determining repeatedly determines the position of the person and wherein said means for reproducing is continuously controlled in response to changes in the position of the head of the person.

4. The system according to claim 1, wherein each of the plural means for reproducing comprises a speaker.

5. The system according to claim 1, wherein each of the plural means for reproducing comprises at least a pair of vertically arranged speakers.

6. The system according to claim 1, wherein the position of the person is determined in three dimensions, including horizontal and vertical directions.

7. The system according to claim 6, wherein each of the plural means for reproducing comprises at least a pair of vertically arranged speakers.

8. The system according to claim 7, wherein the volume of reproduction by each of a pair of vertically arranged speakers is based on the position of the head of the person in the vertical direction.

9. The system according to claim 8, wherein when the head of the person is positioned below a vertical threshold, substantially all of the sound reproduced by the pair of the speakers is reproduced by a vertically lower one of the pair and wherein when the head of the person is positioned above the vertical threshold, substantially all of the sound reproduced by the pair of speakers is reproduced by a vertically higher one of the pair.

10. The system according to claim 9, wherein the threshold is hysteretic.

11. The system according to claim 9, wherein when the head of the person transitions across the threshold, transitioning of the sounds from one speaker of the pair to the other is gradual.

12. The system according to claim 1, wherein the plural means for reproducing are arranged spaced apart and directed toward a center and wherein a particular one of the audio signals applied to a particular one of the means for reproducing is multiplied by a ratio of a horizontal distance between the particular means for reproducing and the head of the person to a horizontal distance between the particular means for reproducing and the center.

13. The system according to claim 1, wherein the particular one of the audio signals is multiplied by a factor related to the position to determine a desired signal level for the particular one of the audio signals and when the desired signal level is substantially different from a current signal level gradually adjusting the current signal level toward the desired signal level.

14. The system according to claim 13, wherein the sounds are digitally sampled at a sampling rate and the current signal level is incrementally adjusted in uniform increments, one adjustment for each of a predetermined number of samples.

15. The system according to claim 14, wherein the increment is related to a difference between the desired signal level and the current signal level.

16. The system according to claim 1, wherein the particular one of the audio signals is time delayed by:

computing a desired delay by determining a distance between the head of the person and the particular means for reproducing to determine a result and dividing the result by the speed of sound; and when the desired delay is substantially different from a current delay, gradually adjusting the current delay toward the desired delay.

17. The system according to claim 16, wherein the sounds are digitally sampled at a sampling rate and the current delay is gradually adjusted by approximately between three and ten percent of the sampling rate.

18. The system according to claim 1, further comprising means for displaying visual images to the user including a source of the sounds.

19. A method for audio reproduction comprising:

obtaining one or more audio signals that are representative of sounds occurring at a first location;

communicating the audio signals from the first location to a second location of a person;

determining a position of the head of the person in at least two dimensions at the second location by imaging the person;

reproducing an audio field at the second location from the audio signals, wherein sounds emitted by each of plural means for reproducing are controlled based on the position of the head of the person, wherein a particular one of the audio signals is multiplied by a factor related to the position to determine a desired signal level for the particular one of the audio signals and when the desired signal level is substantially different from a current signal level gradually adjusting the current signal level toward the desired signal level; and modifying the audio signals to achieve a time delay of the sounds emitted by the plural means for reproducing to maintain equal arrival times of the sounds to the person as the person moves around to different locations at the second location, wherein the audio signals applied to the plural means for reproducing are multiplied by a ratio of a horizontal distance between the plural means for reproducing and the head of the person to a horizontal distance between the plural means for reproducing and a center.

20. The method according to claim 19, wherein delay associated with volume of reproduction by each means for reproducing is controlled based on the position of the head of the person.

21. The method according to claim 19, wherein the audio field is controlled based on the position of the person's head in three dimensions.

22. A telepresence system comprising:

a display booth having a plurality of cameras for obtaining images of a person within the display booth;

a computer system for determining a position of the head of the person in at least two dimensions from the images of the person; and a plurality of speakers for reproducing an audio field at the display booth, wherein the audio field is controlled based on the position of the head of the person, wherein the plurality of speakers are arranged spaced apart and directed toward a center and wherein audio signals applied to the plurality of speakers are multiplied by a ratio of a horizontal distance between the plurality of speakers and the head of the person to a horizontal distance between the plurality of speakers for reproducing and the center.

23. The telepresence system according to claim 22, wherein volume of reproduction by each speaker is controlled based on the position of the head of the person.

24. The telepresence system according to claim 22, wherein delay associated with volume of reproduction by each speaker is controlled based on the position of the head of the person.

25. The telepresence system according to claim 22, wherein the audio field is controlled based on the position of the person's head in three dimensions.

* * * * *

UNITED STATES PATENT AND TRADEMARK OFFICE

CERTIFICATE OF CORRECTION

PATENT NO. : 7,613,313 B2
APPLICATION NO. : 10/754933
DATED : November 3, 2009
INVENTOR(S) : Norman Paul Jouppi et al.

It is certified that error appears in the above-identified patent and that said Letters Patent is hereby corrected as shown below:

On the Title page, in field (75), Inventors, in column 1, line 1, delete "Norman Paul Juppi," and insert -- Norman Paul Jouppi, --, therefor.

In column 10, line 3, in Claim 1, delete "the head" and insert -- a head --, therefor.

In column 10, line 42, in Claim 8, delete "the volume" and insert -- a volume --, therefor.

In column 11, line 1, in Claim 13, delete "the particular" and insert -- a particular --, therefor.

In column 11, line 36, in Claim 19, delete "the head" and insert -- a head --, therefor.

In column 12, line 23, in Claim 22, delete "the head" and insert -- a head --, therefor.

Signed and Sealed this

Sixteenth Day of March, 2010

David J. Kappos

David J. Kappos
*Director of the United States Patent and Trademark Office*